US006079165A

United States Patent [19]

Bingel, III et al.

[11] Patent Number: 6,079,165

[45] Date of Patent: Jun. 27, 2000

[54] APPARATUS AND METHOD FOR BRACING VERTICAL STRUCTURES

[75] Inventors: Nelson G. Bingel, III, Orchard Park; Lawrence J Geitner, Hamburg, both of N.Y.

[73] Assignee: Osmose Wood Preserving, Inc., Buffalo, N.Y.

[21] Appl. No.: 09/082,706

[22] Filed: May 21, 1998

Related U.S. Application Data

[60] Provisional application No. 60/047,443, May 22, 1997.

[51] Int. Cl.[7] ..... E04G 23/04

[52] U.S. Cl. ..... 52/170; 52/730.6; 52/731.7

[58] Field of Search ..... 52/170, 733.2, 52/736.1, 737.3, 730.6, 731.7

[56] References Cited

U.S. PATENT DOCUMENTS

| | | | |
|---|---|---|---|
| 574,641 | 1/1897 | Streator | 52/170 |
| 1,609,541 | 12/1926 | Gooding | 52/733.2 |
| 1,960,961 | 5/1934 | Thomas | 72/115 |
| 3,309,824 | 3/1967 | Barrett . | |
| 3,350,822 | 11/1967 | Nachazel . | |
| 3,362,124 | 1/1968 | Cravens et al. . | |
| 3,387,418 | 6/1968 | Tyrer | 52/242 |
| 3,950,912 | 4/1976 | Lundberg et al. | 52/727 |
| 4,258,523 | 3/1981 | Waugh | 52/732 |
| 4,756,130 | 7/1988 | Burtelson . | |
| 4,881,355 | 11/1989 | Bosl et al. | 52/738 |
| 4,987,718 | 1/1991 | Knight | 52/742 |
| 5,383,749 | 1/1995 | Reisdorff et al. . | |
| 5,464,302 | 11/1995 | Menchetti | 403/335 |
| 5,622,356 | 4/1997 | Duggan | 256/1 |

OTHER PUBLICATIONS

Osmose Wood Preserving, Inc.; Buffalo, New York; Pamphlet entitled Osmo–C Truss.

*Primary Examiner*—Beth A. Stephan
*Attorney, Agent, or Firm*—Hodgson Russ Andrews Woods & Goodyear LLP

[57] ABSTRACT

A reinforcing apparatus for supporting a utility pole against the bending forces of transverse wind components is described. The apparatus comprises an intermediate section extending to and meeting with spaced apart flanges. The intermediate section and the flanges are configured such that the elastic axis and shear center of the reinforcing apparatus is closer to the longitudinal axis of the pole and the point of load transfer from the pole than realized by prior art reinforcing apparatus. The intermediate section may have a variety of shapes, such as a "U" shape, "V" shape, or channel shape. The reinforcing apparatus may be constructed of high yield strength steel and is secured to the pole by means of one or more bands, or by means of bolts, screws or other fastening means.

42 Claims, 9 Drawing Sheets

FIG. 8
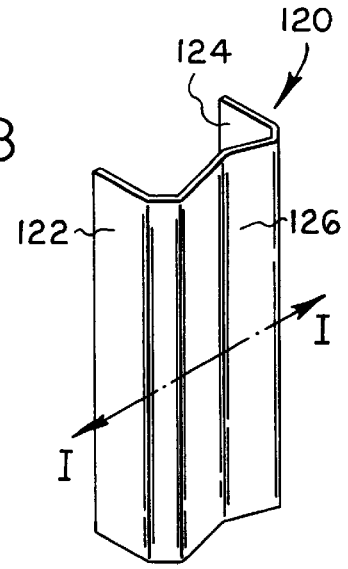
FIG. 8A
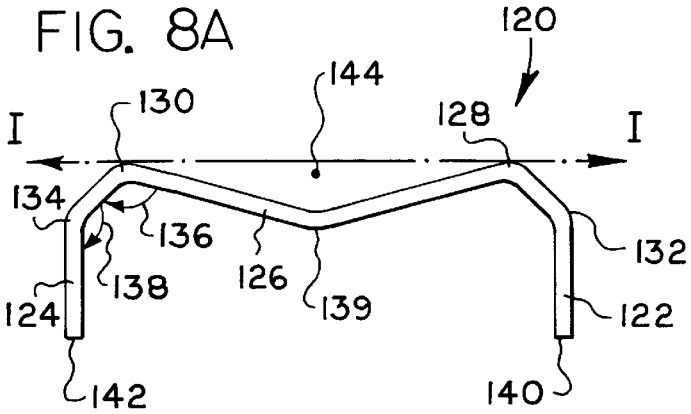
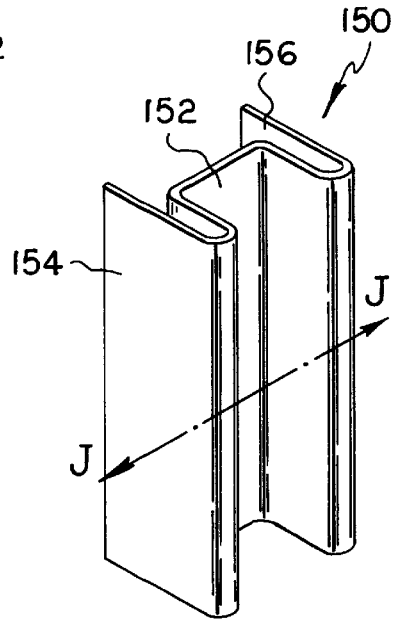
FIG. 9
FIG. 9A
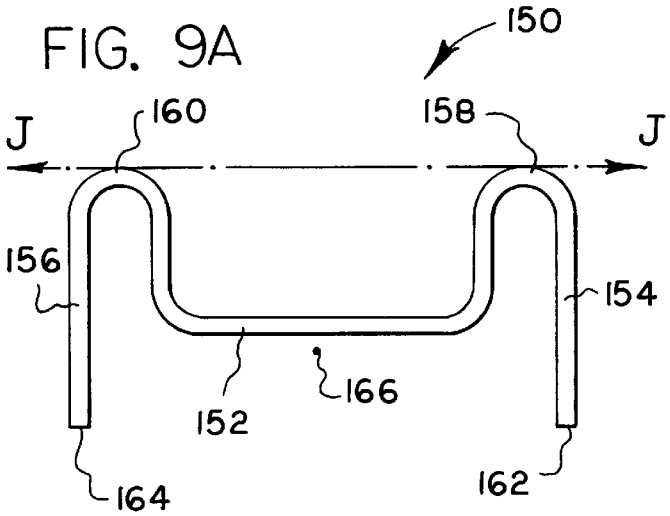

FIG. 17
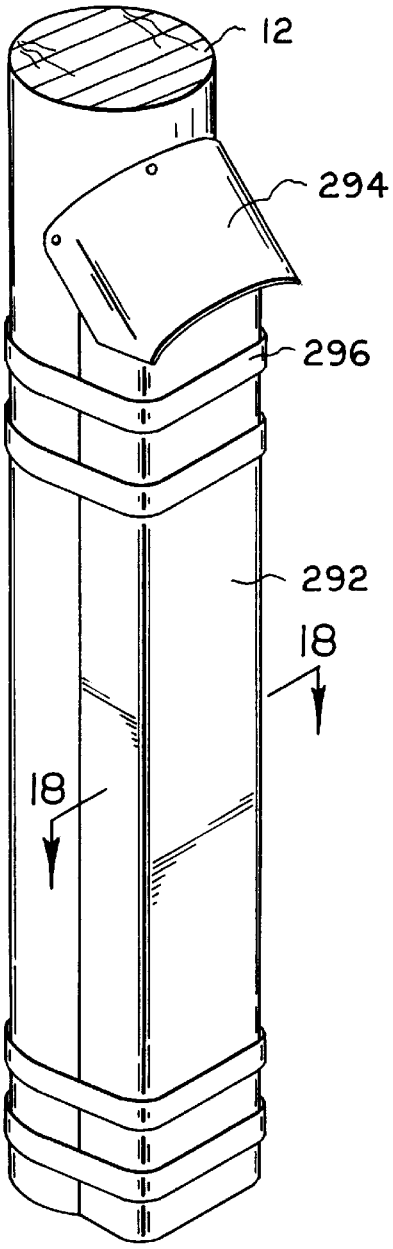
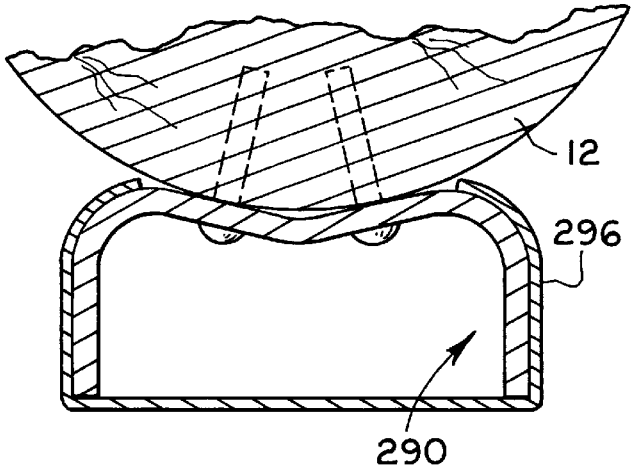
FIG. 18
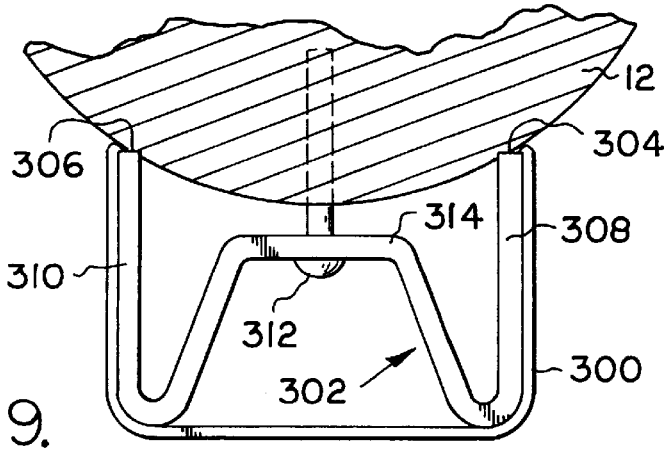
FIG 19.

APPARATUS AND METHOD FOR BRACING VERTICAL STRUCTURES

CROSS REFERENCE TO RELATED APPLICATION

This application claims priority on earlier filed provisional application Ser. No. 60/047,443 May 22, 1997, which is incorporated herein by reference.

BACKGROUND OF THE INVENTION

1. Field of the Invention

The present invention relates to a reinforcing apparatus for bracing, splinting, or otherwise supporting vertical structures, such as utility poles, power distribution and transmission poles, telephone poles, and like poles and structures, against the forces exerted upon them by environmental factors such as transverse and shear winds. More specifically, the present invention is directed to an improved reinforcing apparatus which when secured to a utility pole and the like minimizes the tendency of the apparatus to twist and rotate under applied loads.

2. Description of the Related Art

Utility lines, such as those carrying electrical power, cable television signals or telephone signals, have traditionally been supported above ground using poles, and especially wooden poles. As used herein, the term "pole" includes various forms and definitions of elongated support members, e.g., posts and pilings, whether or not constructed of wood. Such poles must be capable of withstanding not only the columnar load applied by the weight of the objects supported thereon but also the transverse or horizontal load imposed by the transverse winds. In addition, after some years in service, wood utility poles tend to experience decay and rotting just below and slightly above ground level.

While the decayed region is normally relatively small and the penetration of the decay may be limited, the pole is nonetheless structurally weakened and may not be sufficiently strong to resist wind and other forces. Under these conditions, wind forces can result in a pole breaking and toppling, sometimes without warning.

Therefore, it is necessary to periodically replace older wooden poles. The demand for replacement poles, in combination with the demand for new poles, has become increasingly difficult to meet. Such a demand presents environmental concerns related to deforestation and the toxic effects of preservative chemicals used to treat the poles. In addition, replacement of existing poles is expensive and may require interruption of service to users of the utility. To overcome these and other problems associated with pole replacement, various methods and apparatus for reinforcing in-service poles have been developed to extend their useful life.

One technique for reinforcing utility poles is that of coupling an elongate brace or truss to the pole, in effect splinting or bridging across the weakened area of the pole. Such braces are customarily adapted to extend at least partway along the pole parallel to its longitudinal axis to provide support against transverse wind forces, and other loading conditions.

One such pole reinforcing apparatus is the Osmose® Osmo-C-Truss™ system. This reinforcing apparatus, developed by the inventor of the present invention, helps to restore the groundline strength of utility poles at a fraction of the cost of pole replacement. The Osmo-C-Truss™ comprises a C-shaped galvanized steel reinforcing apparatus which is secured to a pole by a plurality of galvanized steel bands fastened around the perimeter of the truss/pole assembly. The Osmo-C-Truss™ can extend the life of a pole for many years and is installed without interrupting power to utility customers.

In spite of the many advantages of the Osmo-C-Truss™, some performance issues are inherent in the use of a "C" or channel shaped reinforcing apparatus. One significant performance issue is related to the ability of a "C" or channel shaped design to withstand bending loads from a pole without twisting or rotating about the pole. One solution in the prior art is to increase or "beef up" the capacity of the apparatus by increasing its dimensions or the yield strength of the material of construction. However, these approaches fail to consider the underlying mechanical principles that govern the performance of such devices under load. Because the shear centers and the elastic axes of the reinforcing apparatus reside well outside the locus of the applied transverse load, there results significant torsional forces acting upon the reinforcing apparatus in addition to the expected bending forces. Specifically, the prior art has not taken into account the relationship between the location of the shear center of a pole reinforcing apparatus and the location of the transverse load applied to the reinforcing apparatus. The further the applied load is from the shear center and elastic axis, the greater the torsional forces that act upon the apparatus in addition to the bending forces. Torsional forces may cause the apparatus to shift its position about the circumference of the pole, i.e., rotate about the pole, to a disadvantageous position. Further, the reinforcing apparatus itself may twist and experience shape distortion when subjected to torsional forces, causing a reduction in performance; possibly less than the theoretical strength of the material of construction would afford.

Without a corresponding decrease in torsional rotation of the apparatus about the pole, or a reduction in the torsional forces themselves, the increased theoretical resistance to bending forces supplied by an apparatus having increased dimensions or higher yield material may be of little practical value. The reinforced apparatus may still undergo unacceptable rotation or twisting deformation causing premature failure before its theoretical bending capacity is reached. Further, while measures such as adding material of higher yield strength may increase theoretical bending support, they represent significant added costs, in many cases without yielding proportionate benefits or efficient results.

Accordingly, there has been a long-standing need for more efficient and cost-effective utility pole reinforcing apparatuses, and especially for a reinforcing apparatus that minimizes torsional forces and rotation of the apparatus about the pole, thereby increasing the ability of the apparatus to withstand transverse forces. This is especially important when using higher yield strength materials because to gain benefit from the higher material strength requires greater deflection of the pole from loading. Greater deflection of the pole causes more twisting and deformation of the reinforcing apparatus, which is likely to cause failure before the theoretical strength of the prior art reinforcing apparatus is met. The structures of the present reinforcing apparatus can withstand higher loading forces and, therefore, make better use of higher strength materials, such as high strength steels.

SUMMARY OF THE INVENTION

It is, therefore, an object of the present invention to provide a pole reinforcing apparatus which minimizes torsional forces and rotation of the apparatus about the pole, thereby improving the mechanical design and increasing the ability of the apparatus to withstand transverse forces, especially with higher yield strength materials of construction.

It is a further object of the present invention to provide a pole reinforcing apparatus configured such that the flexural center, or shear center, of the apparatus is in a closely spaced relationship to the point of load transfer from the pole to the reinforcing apparatus when the apparatus is operationally secured to the pole.

It is a further object of the present invention to provide a pole reinforcing apparatus which remains in a predetermined position when operationally secured to a pole such that the apparatus does not twist or rotate about the pole under the influence of transverse forces acting on the reinforcing apparatus/pole assembly during use.

It is a further object of the present invention to provide a pole reinforcing apparatus comprising an intermediate section extending to and meeting with spaced apart, outermost flanges and having a first plane tangent to respective junctions between the intermediate section and the spaced apart outermost flanges, wherein an apex portion of the intermediate section between the junctions deflects either towards or away from the first plane and wherein the first plane does not intersect any part of the reinforcing apparatus except at the tangent locations. The intermediate section may have a generally V-shaped cross section, a generally U-shaped cross section, a generally channel shaped cross section, or a wide variety of other cross sectional shapes.

In that respect, a reinforcing apparatus according to the present invention generally comprises an intermediate section extending to and meeting with spaced apart, outermost flanges and having a plane tangent to respective junctions between the intermediate section and the spaced apart flanges. An apex portion of the intermediate section between the junctions deflects either towards or away from the first plane, and wherein the reinforcing apparatus is symmetrical along a second plane bisecting the intermediate section and unsymmetrical along a third plane tangent to the apex portion, and wherein a shear center of the reinforcing apparatus is located at one of the locations consisting of: spaced from the first plane tangent to the respective junctions between the intermediate section and the flanges and outside the confines of the first plane and the intermediate section; within the confines of the first plane and the intermediate section; along the first plane; and coincident with the intermediate section.

The reinforcing apparatus may be constructed of high strength steel which can have a yield strength of at least about 36,000 psi., and more preferably, of at least about 70,000 psi. Other materials of construction include aluminum and composites of fiber reinforced materials, such as E-glass, S-glass, aramid and carbon.

BRIEF DESCRIPTION OF THE DRAWINGS

The following description taken in conjunction with the accompanying drawings will be readily understood by one skilled in the art as fully enabling of the invention. The best mode of practicing the invention known at the present time is described herein. Understanding that these drawings depict only typical embodiments of the invention and are, therefore, not to be considered limiting of its scope, the present invention will be described with additional specificity and detail through use of the accompanying drawings, in which:

FIG. 8 is a perspective view of a pole reinforcing apparatus 120 according to the present invention.

FIG. 8A is a plan view of the pole reinforcing apparatus 120 shown in FIG. 8.

FIG. 9 is a perspective view of a pole reinforcing apparatus 150 according to the present invention.

FIG. 9A is a plan view of the pole reinforcing apparatus 150 shown in FIG. 9.

FIG. 17 is a perspective view of a cover 292 housing a reinforcing apparatus (not shown) secured to a utility pole 12.

FIG. 18 is a cross-sectional view along line 18—18 of FIG. 17.

FIG. 19 is a plan view of a reinforcing apparatus 302 and cover 300 secured to a utility pole 12.

DETAILED DESCRIPTION OF THE INVENTION

For purposes of this specification, the term "elastic axis" is the line, lengthwise of a beam, along which transverse loads must be applied in order to produce bending only, with no torsion of the beam at any section. Usually the elastic axis is assumed to be the line that passes through the elastic center of every section.

For purposes of this specification, the term "flexural center" is used synonymously with the term "shear center" with respect to a pole reinforcing apparatus. The flexural center of any section of a pole reinforcing apparatus is that point in the plane of the section through which a transverse load, applied at that section, must act if bending deflection only is to be produced, with no twisting of the section. In other words, if a transverse load is applied to a pole at a point displaced from the flexural center or shear center of the associated reinforcing apparatus, the apparatus will experience both bending deflection and twisting in response to the applied load.

Generally, a reinforcing apparatus according to the present invention comprises an intermediate section extending to and meeting with a pair of spaced apart, outermost flanges. As will be described in detail hereinafter, the intermediate section can have various shapes and configuration between the outermost flanges, and the various embodiments shown and described herein are only representations of them.

The determination of elastic axis and flexural center of generally beam or channel shaped structures is well known in the mechanical arts. For background information on computation of shear center, flexural center and elastic axis of such structures reference is made to Roark's Formulas for Stress and Strain, Sixth Edition, McGraw-Hill Book Company, 1989, the contents of which are hereby incorporated by reference.

Figure 1:
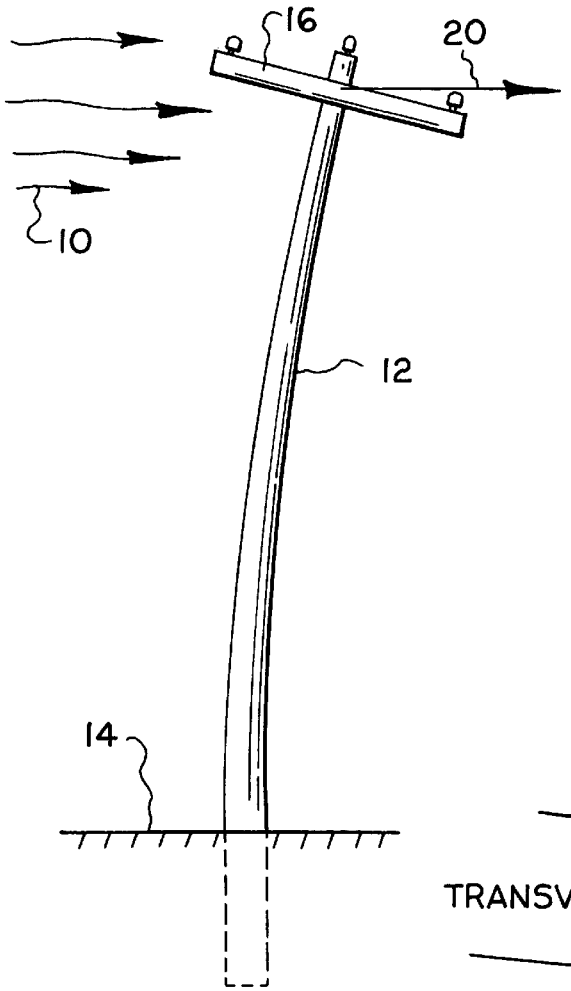
FIG. 1 is a pictorial diagram showing the bending effect of wind upon a utility pole 12.
Figure 2:
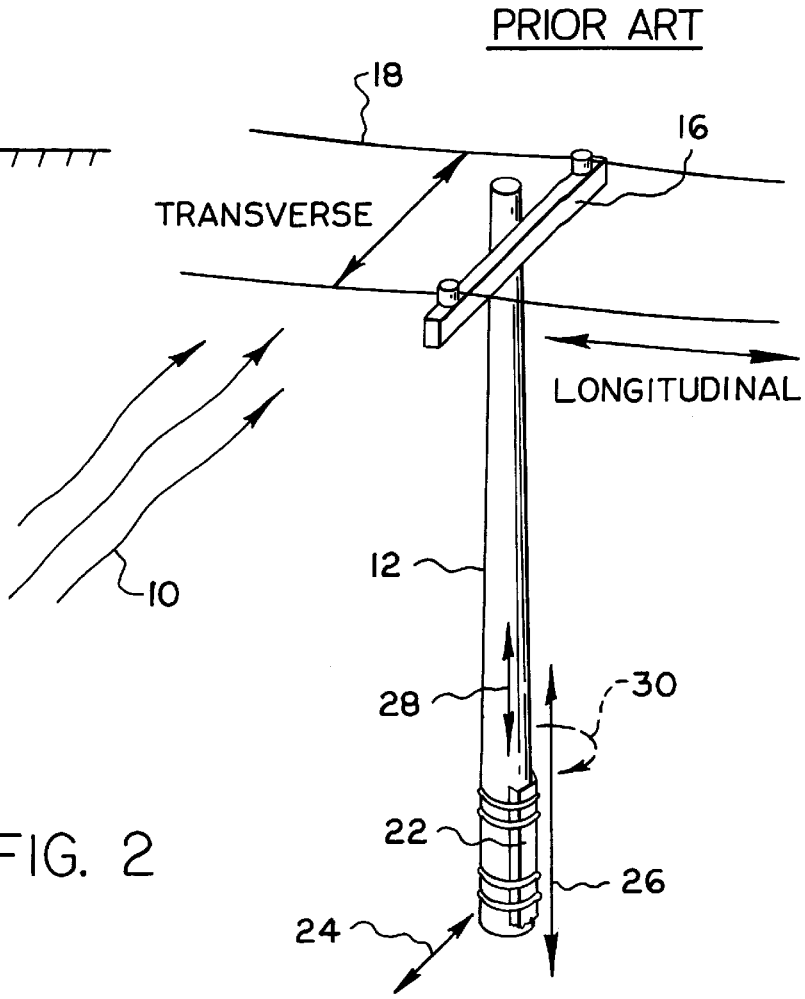
FIG. 2 is a pictorial diagram showing a typical prior art reinforcing apparatus 22 secured to the utility pole 12.

Turning now to the drawings, FIGS. 1 and 2 illustrate the effect of transverse wind forces 10 acting upon a typical utility pole 12. Ground level is shown at 14. As a general rule, the length of the underground section of the utility pole 12 should be deep enough to provide adequate foundation and support for the above ground portion of the pole. A transverse support beam 16 is provided near the top of the pole 12 and supports utility wires 18. If the wind forces 10 are strong enough, the pole will bend in the direction of the applied or transverse wind force component 20. A typical pole reinforcing apparatus 22 (FIG. 2) of the prior art is shown secured to the pole 12 in a position intended to resist the bending forces acting upon the pole. However, wind forces 10, or components thereof, not only act upon the pole 12, they also act upon the wires 18 such that the pole tends to bend in the direction indicated by vector component 24 of the applied wind force. The bending movement of the pole in direction 24 applies a transverse load to the prior art pole reinforcing apparatus 22 in the general direction of the force component 24.

The flexural center and the elastic axis of the prior art reinforcing apparatus 22 lie generally along line 26 spaced from the assembly of the utility pole 12/reinforcing apparatus 22. In that respect, the flexural center and the elastic axis 26 are displaced from the central, longitudinal axis 28 of the pole 12, and also from where the transverse forces are applied to the apparatus 22 by the deflection of the pole. Consequently, when the transverse wind forces, i.e., a wind force having a direction indicated by numeral 24, are of a sufficient magnitude, undesirable twisting of the prior art reinforcing apparatus 22 about the longitudinal axis 28 of the pole 12 can result, as indicated by dashed line 30. This is because a transverse force applied to a reinforcing apparatus including the prior art reinforcing apparatus 22 other than at its flexural center produces not only bending deflection but twisting of the reinforcing apparatus 22. Thus, the prior art reinforcing apparatus 22 tends to distort and, in addition, shift its position on the pole 12. This deformation and shifting movement adversely affects the ability of the prior art reinforcing apparatus 22 to meet theoretical strengths during verification tests.

Figure 3:
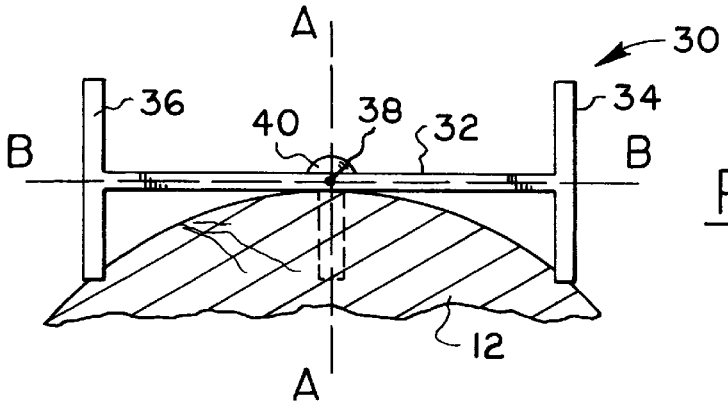
FIG. 3 PRIOR ART
FIG. 3 is a plan view of a prior art reinforcing apparatus 30 having an I-beam configuration and secured to a utility pole 12.
Figure 4:
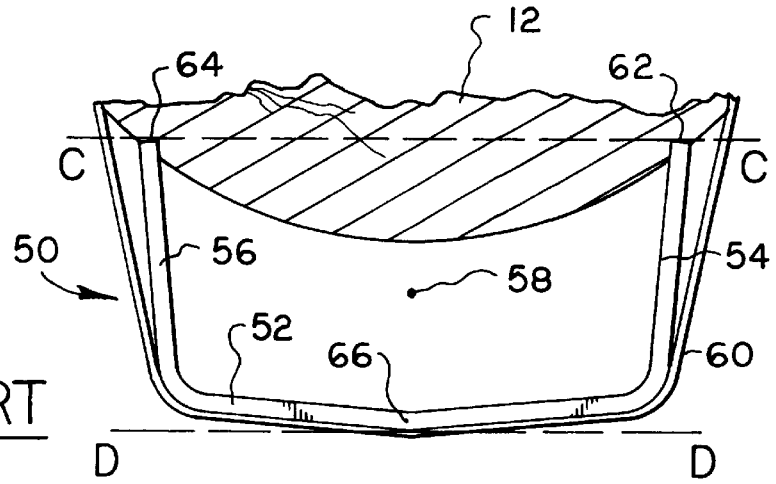
FIG. 4 PRIOR ART
FIG. 4 is a plan view of a prior art reinforcing apparatus 50 having a C-shaped configuration and secured to a utility pole 12.
Figure 5:
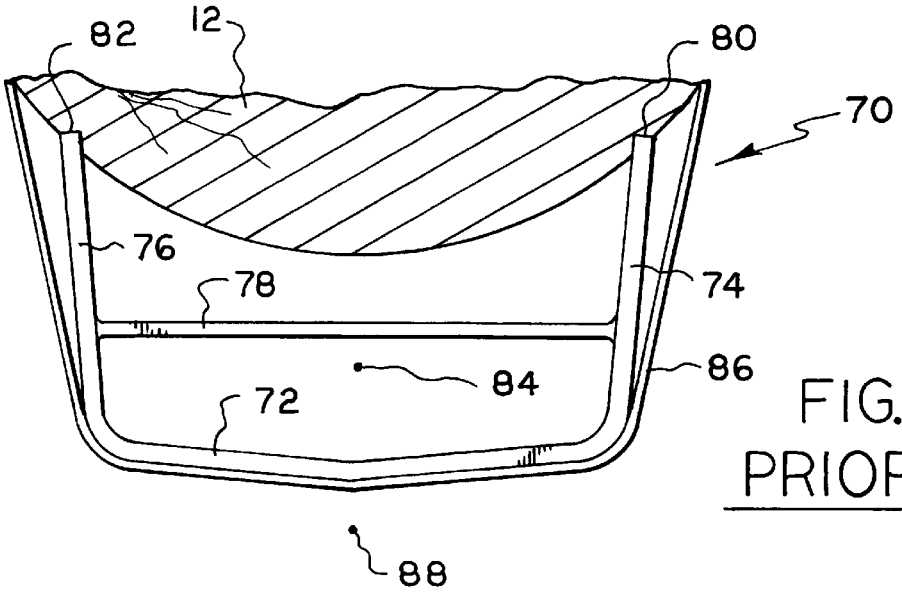
FIG. 5 PRIOR ART
FIG. 5 is a plan view of a prior art reinforcing apparatus 70 having a C-shaped configuration bolstered by a support plate 78 connecting between spaced apart flanges 74 and 76 and secured to a utility pole 12.

FIGS. 3 to 5 show additional representative embodiments of reinforcing apparatuses according to the prior art. In particular, FIG. 3 shows a prior art reinforcing apparatus 30 having an I-beam configuration comprising a central plate 32 extending to and meeting with spaced apart flanges 34 and 36. Central plate 32 bifurcates the flanges 34, 36 such that the reinforcing apparatus 30 is symmetrical about a plane A—A bisecting the central plate 32 and plane B—B bisecting both the central plate and the flanges 34, 36. The center of gravity for reinforcing apparatus 30, indicated by point 38, is intersected by the planes A—A and B—B. When the reinforcing apparatus 30 is secured to the utility pole 12 by a fastener 40, the shear center of the reinforcing apparatus is located at the center of gravity point 38.

FIG. 4 shows another prior art reinforcing apparatus 50 comprising an intermediate section 52 extending to and meeting with spaced apart flanges 54 and 56. The reinforcing apparatus 50 has a C-shaped configuration with a center of gravity point indicated at 58. In use, the reinforcing apparatus 50 is secured to the utility pole 12 by a fastener such as bands 60 with the terminal ends 62 and 64 of flanges 54, 56 extending into the pole 12. The reinforcing apparatus has its shear center located at the point indicated at 66 bounded by the reinforcing apparatus 50 and a plane C—C contacting the respective terminal ends 62,64 of the flanges 54, 56.

FIG. 5 shows still another prior art reinforcing apparatus 70, similar to the reinforcing apparatus 50 shown in FIG. 4, comprising an intermediate section 72 extending to and meeting with spaced apart flanges 74 and 76. This C-shaped reinforcing apparatus is bolstered by a support plate 78 extending to and meeting with the flanges at opposed positions between the terminal ends 80 and 82 of the flanges and the intermediate section 72. The center of gravity of this prior art apparatus is located at the point indicated at 84. When the reinforcing apparatus 80 is secured to the utility pole 12 by a band 86, the assembly has its shear center located at the point indicated at 88.

As will be explained in detail presently, the reinforcing apparatus according to the present invention reduces torsional forces which inherently reduces twisting about the pole and shape distortion compared to the prior art reinforcing apparatuses.

Figure 6:
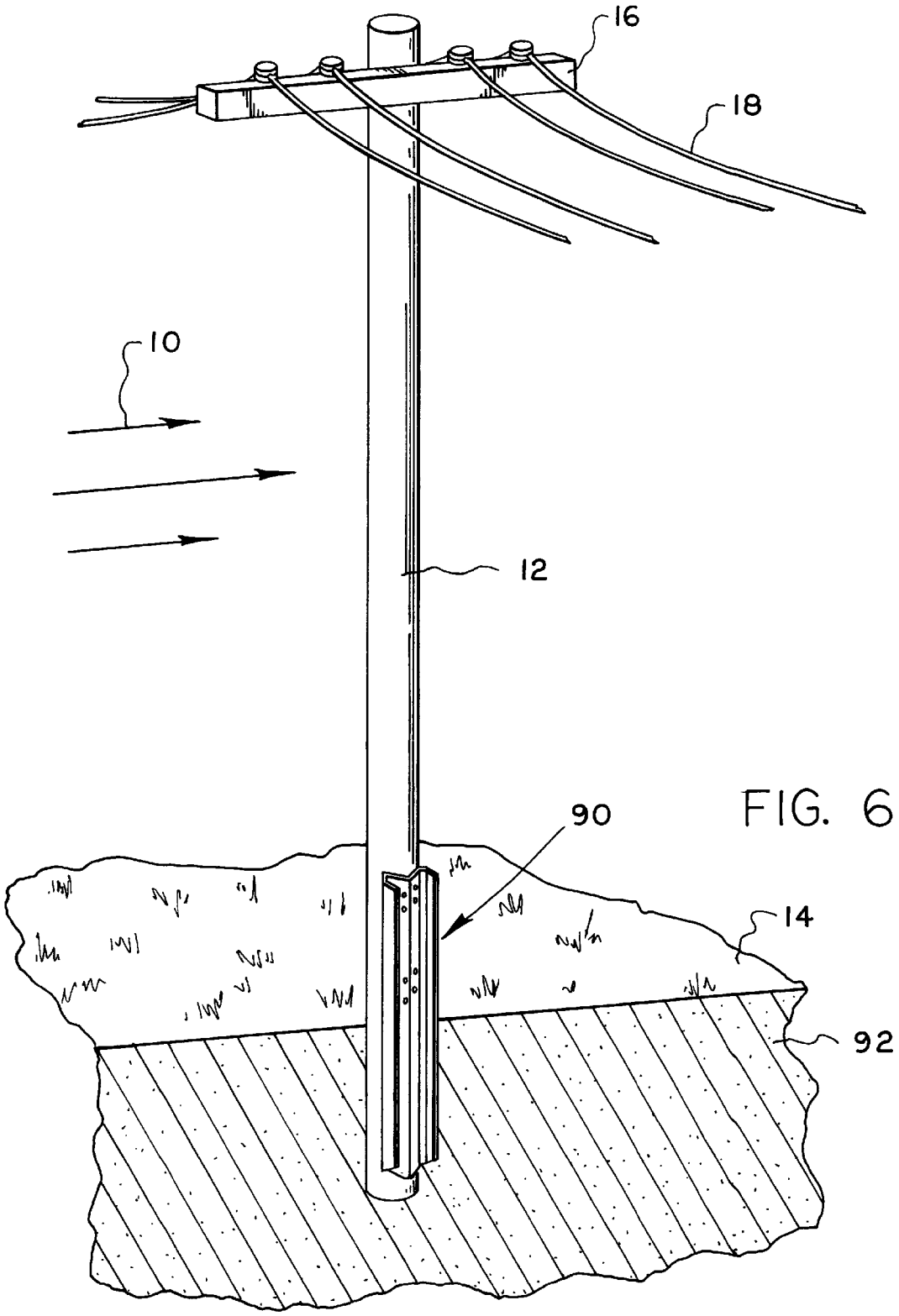
FIG. 6 is a perspective view, partly in cross-section, of a representative embodiment of a pole reinforcing apparatus 90 of the present invention secured to the utility pole 12.

FIG. 6 is a perspective view of a representative pole reinforcing apparatus 90 according to the present invention as it appears secured to the utility pole 12. Again, ground level is depicted at 14 and the underground is depicted at 92. Reinforcing apparatus 90 is approximately 10 ft. in length and is positioned on pole 12 such that about a 5 ft. section of the apparatus 90 extends below the ground level 14. Those skilled in the art will appreciate, however, that the reinforcing apparatus 90 may be either longer or shorter than that, and may extend to varying depths into the underground 92 while remaining within the scope of the present invention.

The representative reinforcing apparatus 90 according to the present invention (FIG. 6), which is secured to a weakened utility pole so as to extend axially at least partway along the length thereof in order to brace or splint the pole against the bending forces of transverse winds, also generally comprises an intermediate section extending to and meeting with spaced apart flange sections. However, in contrast to the prior art reinforcing apparatus, a characterizing structure of the present reinforcing apparatus is that an apex portion of the intermediate section deflects towards the terminal ends of the flanges. In the prior art C-shaped reinforcing apparatus 30, 50 and 70 shown in FIGS. 3 to 5, there is no such deflected structure.

In that respect, the prior art C-shaped reinforcing apparatuses 50 and 70 shown in FIGS. 4 and 5 do not include a plane tangent to respective junctions between the intermediate section and the spaced apart flanges with an apex portion of the intermediate section deflecting either towards or away from the tangent plane. Instead, at the apex of the intermediate sections of the reinforcing apparatuses 50 and 70, the intermediate sections 52 and 72 are continuously extending away from a plane tangent to the apex, for example plane D—D in FIG. 4, and towards the respective flanges which in turn extend to terminal ends, spaced at a maximum distance with respect to the intermediate section as determined by the distance between the terminal ends and the apex of the intermediate section. In other words, the intermediate section in the prior art reinforcing apparatus 50 (FIG. 4) does not include a portion that deflects towards the plane D—D.

Figure 7:
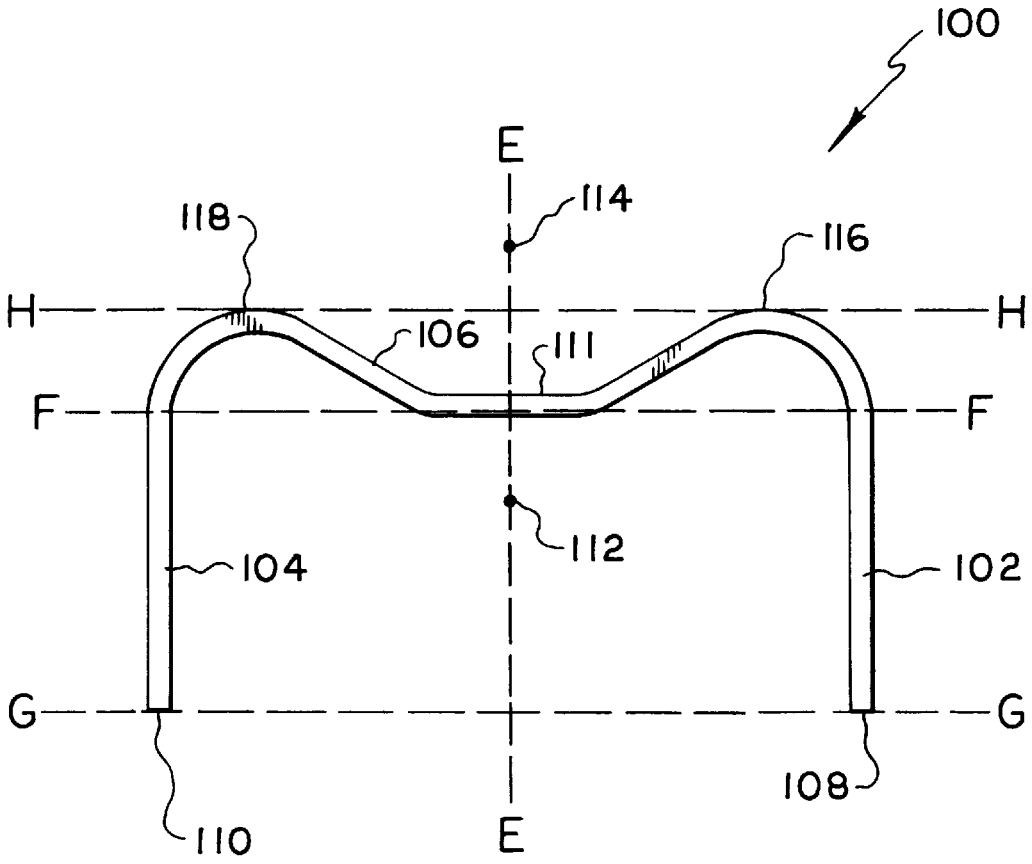
FIG. 7 is a plan view of a reinforcing apparatus 100 according to the present invention.

A plan view of one embodiment of a reinforcing apparatus 100 according to the present invention is shown in FIG. 7 and comprises spaced apart legs or flanges 102 and 104 integrally connected to an intermediate section 106. The flanges 102, 104 have respective terminal ends 108 and 110 with an apex 111 of the intermediate section deflecting towards the terminal ends. Such an apparatus is characterized as having symmetry about a plane E—E bisecting the intermediate section 106 but is unsymmetrical about a plane F—F intersecting flanges 102, 104. The center of gravity, indicated by point 112, is located within the confines of the reinforcing apparatus 100 and a plane G—G tangent to the respective terminal ends 108, 110 of the flanges 102 and 104.

In one typical assembly configuration, the reinforcing apparatus is positioned to receive the pole (not shown) cradled between and contacted by the spaced apart flanges with the intermediate section either spaced from the pole or contacting the pole at an intermediate contact point. In a second typical assembly configuration, the reinforcing apparatus cradles the pole in the intermediate section with the spaced apart flanges extending away from the pole. In either configuration, the shear center of the reinforcing apparatus, indicated by point 114, resides along the plane E—E but outside the confines of a plane H—H tangent to the respective junctions 116,118 between the flanges 102, 104 and the intermediate section 106. In that respect, the shear center is moved closer to the applied load point from the pole (not shown) than is realized with the prior art reinforcing apparatus (FIGS. 4 to 6) to thereby support the weakened pole and help prevent transverse loads from twisting the reinforcing apparatus. It should be understood that the reinforcing apparatus 100 can be secured to a utility pole in either direction with the pole cradled between the flanges 102,104 or cradled in the intermediate section 106.

FIGS. 8 and 8A show one preferred embodiment of a pole reinforcing apparatus 120 according to the present invention comprising spaced apart flanges 122 and 124 and an intermediate section 126. The intermediate section 126 extends to and meets with first angled junctions 128 and 130 which in turn extend to and meet with second angled junctions 132 and 134. The flanges 122, 124 are parallel to each other, and each of the pairs of angles 136 and 138 at the respective first and second junctions are obtuse angles. The obtuse angle pairs can be constructed as equals, or one of the angles 136 and/or 138 between one of the flanges 122, 124 and the intermediate section 126 can be less than the other. While not shown, the angles 136 and/or 138 can even be acute. Any one of these different angle embodiments may or may not result in the flanges 122, 124 remaining parallel.

Intermediate section 126 has a splayed V-shape with an apex 139 that deflects in the general direction of the terminal ends 140 and 142 of the flanges 122 and 124 and away from a plane I—I tangent to the junctions 128,130 of the intermediate section 126 and the flanges 122,124. A characterizing feature of the present invention is that the shear center 144 of the reinforcing apparatus 120 is within the confines of the plane I—I and the intermediate section 126.

While the reinforcing apparatus 120 is shown uniform in cross-section along its length, those skilled in the art will recognize that various non-uniform and asymmetrical shapes may be devised for each of the reinforcing apparatus described herein without departing from the principles of the present invention. This will be described in detail hereinafter.

FIGS. 9 and 9A show another preferred embodiment of a reinforcing apparatus 150 according to the present invention comprising an intermediate section 152 extending to and meeting with spaced apart flanges 154 and 156 at respective junctions 158 and 160. The flanges 154, 156 are parallel to each other, and the junctions between them and the intermediate section 152 are U-shaped. The intermediate section 152 has a channel shape with a trough, similar to the apex 139 in FIGS. 8 and 8A, that deflects in the direction of the terminal ends 162 and 164 of the spaced apart flanges 154 and 156 and away from a plane J—J tangent to the junctions 158 and 160 of the intermediate section and the flanges 154,156. The reinforcing apparatus 150 is uniform in cross-section along its length. The shear center 166 of the reinforcing apparatus 150 is outside the confines of the plane J—J and the intermediate section 152.

Figure 10A:
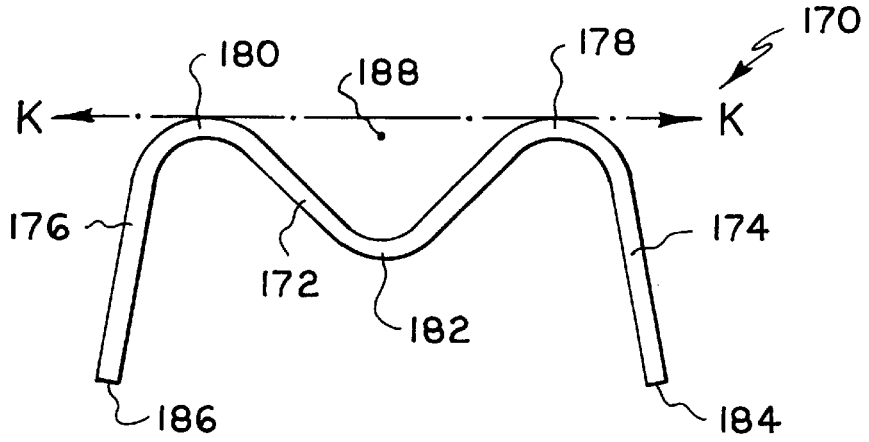
FIG. 10A is a plan view of the pole reinforcing apparatus 170 shown in FIG. 10.
Figure 10:
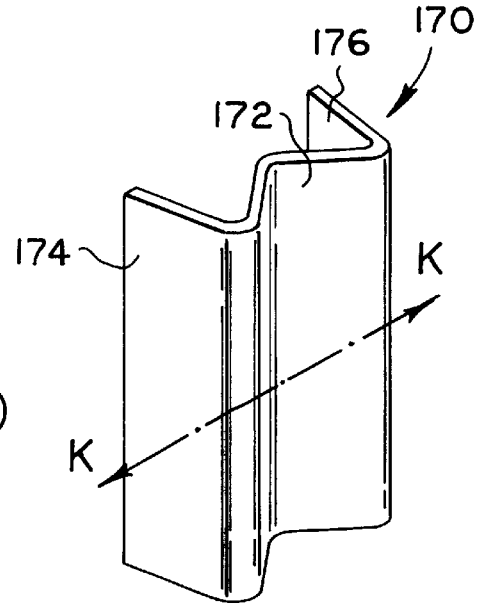
FIG. 10 is a perspective view of a pole reinforcing apparatus 170 according to the present invention.

FIGS. 10 and 10A show another preferred embodiment of a reinforcing apparatus 170 according to the present invention comprising an intermediate section 172 extending to and meeting with spaced apart flanges 174 and 176 at respective junctions 178 and 180. The flanges 174, 176 are angled with respect to each other, and the junctions between them and the intermediate section 172 are curved. The intermediate section 172 has a V-shape with a curved apex 182 that deflects in the direction of the terminal ends 184 and 186 of the spaced apart flanges 174, 176 and away from a plane K—K tangent to the junctions 178, 180 of the intermediate section 172 and the flanges 174,176. The reinforcing apparatus 170 is uniform in cross-section along its length with a shear center 188 of the apparatus bordered by the plane K—K and the intermediate section 172.

It should be understood that a reinforcing apparatus can embody features of various ones of the described apparatus 120, 150 and 170 without departing from the scope of the present invention. For example, a reinforcing apparatus could have a channel-shaped intermediate section, such as intermediate section 152 shown in FIGS. 9 and 9A with angled junctions, such as junctions 128, 130 and 132, 134 shown in FIGS. 8 and 8A. Also, the apex of the intermediate section does not need to be centered or equidistant between the flanges. Other combinations and variations of reinforcing apparatus according to the present invention described herein will be readily apparent to those skilled in the art.

Figure 11:
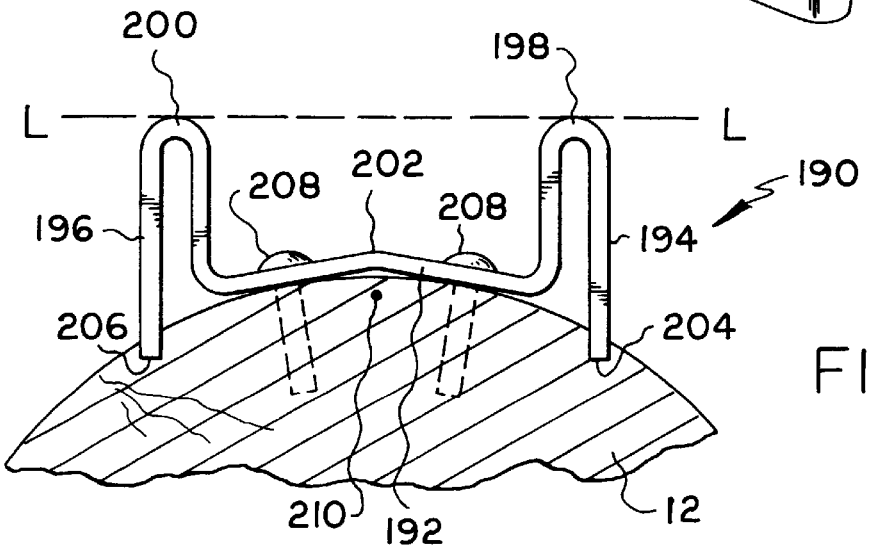
FIG. 11 is a plan view of a reinforcing apparatus 190 according to the present invention secured to a utility pole 12.

FIG. 11 shows another preferred embodiment of a reinforcing apparatus 190 according to the present invention comprising an intermediate section 192 extending to and meeting with spaced apart flanges 194 and 196 at respective junctions 198 and 200. The intermediate section 192 is of a general channel configuration, similar to the intermediate channel 152 of the reinforcing apparatus 150 shown in FIGS. 9 and 9A, but with a splayed V-shape having the apex 202 of the V extending away from the terminal end 204 and 206 of the respective flanges 194 and 196 and towards a plane L—L tangent to the junctions 198,200 of the intermediate section 192 and the flanges 194,196.

With the reinforcing apparatus 190 secured to a utility pole 12 by fasteners, such as bolts 208, the pole is cradled in the crotch of the splayed V-shaped portion 202 having the terminal ends 204, 206 of the flanges 194, 196 contacting, and preferably dug into the pole. In that position, the shear center 210 of the reinforcing apparatus 190 is outside the confines of the plane L—L and the intermediate section 192. The provision of the junctions 198, 200 spaced from the utility pole 12 aids in stabilizing the reinforcing apparatus 190, especially with the terminal ends 204, 206 embedded into the pole.

Figure 12:
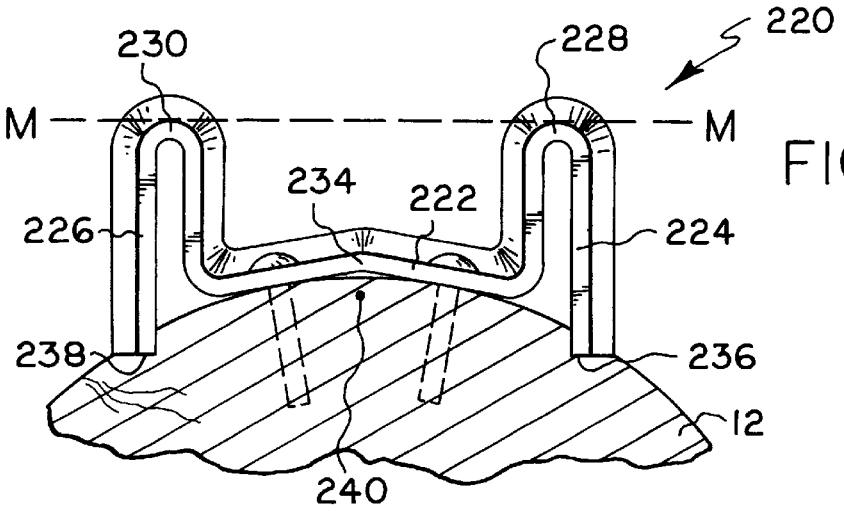
FIG. 12 is a plan view of a reinforcing apparatus 220 according to the present invention secured to a utility pole 12.

FIG. 12 shows another preferred embodiment of a reinforcing apparatus 220 according to the present invention comprising an intermediate section 222 extending to and meeting with spaced apart flanges 224 and 226 at respective junctions 228 and 230. The intermediate section 222 has channel configuration with a splayed V-shaped base having the apex 234 of the V extending away from the terminal ends 236 and 238 of the respective flanges 224, 226 and towards a plane M—M tangent to the junctions 228,230 of the intermediate section 222 and the flanges 224,226. The reinforcing apparatus 220 is secured to the utility pole 12 cradled in the crotch of the splayed V-shaped portion 234 having the terminal ends 236, 238 of the flanges 224, 226 dug into the pole. Again, the shear center 240 of the reinforcing apparatus 220 is outside the confines of the plane M—M and the channel shaped intermediate section 222.

While the construction of the reinforcing apparatus 220 is similar to that of the reinforcing apparatus 190 shown in FIG. 11, a characterizing feature is that the apparatus 220 tapers downwardly and outwardly or inwardly with respect to the utility pole 12. This provides added stabilizing strength to the reinforcing apparatus 220, which serves to enhance the union between the reinforcing apparatus 220 and the utility pole 12. It is contemplated that the thickness of the reinforcing apparatus can increase along its length to provide the taper, or the thickness can remain uniform with the taper provided by thusly shaping the apparatus. Further, those skilled in the art will recognize that the reinforcing apparatus 220 need not have a constant taper along its length, but can have a taper that varies towards and away from the utility pole 12 or the reinforcing apparatus can have only portions that are tapered. Another preferred embodiment of the present invention has the reinforcing apparatus tapering downwardly and inwardly toward the utility pole.

Figure 13:
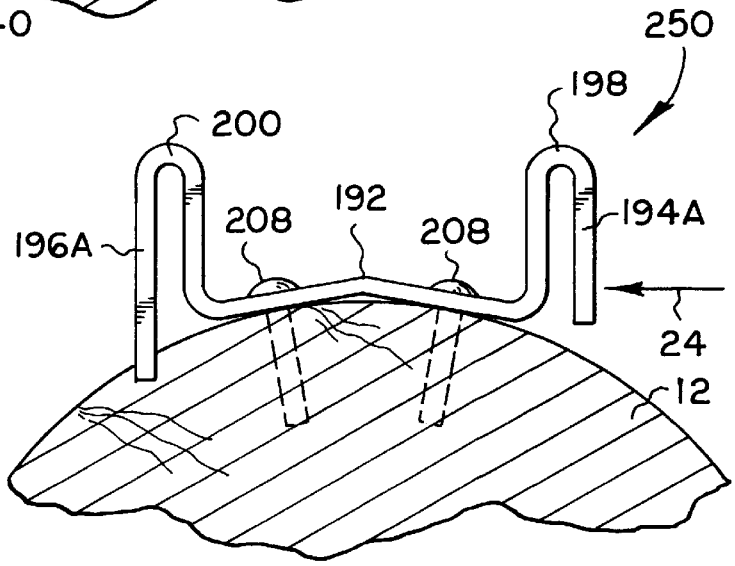
FIG. 13 is a plan view of a reinforcing apparatus 250 according to the present invention secured to a utility pole 12.

FIG. 13 shows another preferred embodiment of a reinforcing apparatus 250 according to the present invention that is similar to the reinforcing apparatus 190 of FIG. 11 except that the flange 194A is somewhat shorter than the corresponding flange 194. In all other respects the two reinforcing apparatus 190 and 250 are similar. Providing flange 194A shorter than flange 194 can be useful in those installations where the wind force component 24 is predominately from a direction initially hitting the shorter flange 194A. In that situation, the increased strength is provided by the longer flange 196A and cost of construction consideration and the like may dictate that flange 194A need not be as long as flange 196A.

Figure 14:
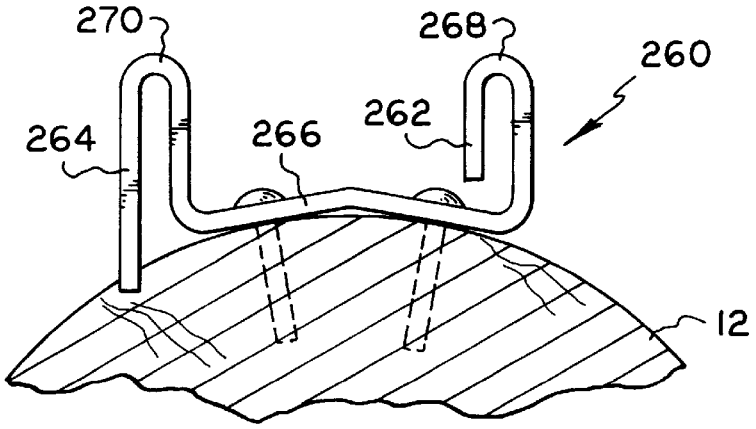
FIG. 14 is a plan view of a reinforcing apparatus 260 according to the present invention secured to a utility pole 12.

FIG. 14 shows another preferred embodiment of a reinforcing apparatus 260 according to the present invention that is similar to the reinforcing apparatus 190 of FIG. 11 and comprises flanges 262, 264 extending to and meeting with an intermediate section 266 at junctions 268 and 270. However, junction 268 is inwardly turned to position flange 262 within the intermediate section 266. If desired, the outwardly turned junction 270 connecting between the intermediate section 266 and flange 264 can also be inwardly turned.

Figure 15:
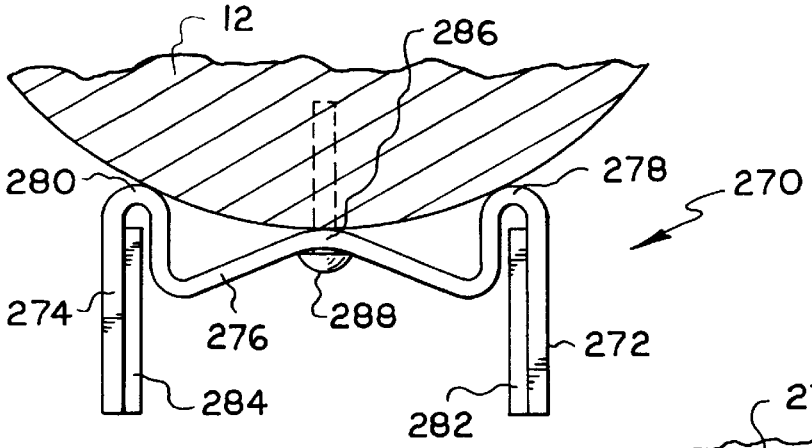
FIG. 15 is a plan view of a reinforcing apparatus 270 according to the present invention secured to a utility pole 12.
Figure 16:
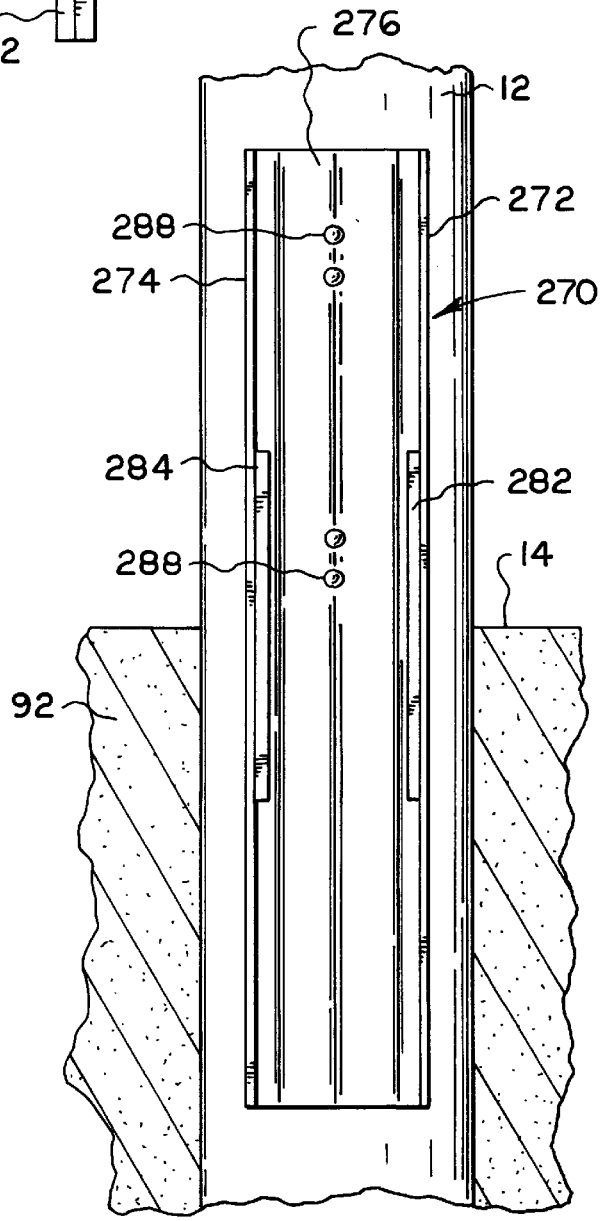
FIG. 16 is an elevational view, partly in cross-section, of the reinforcing apparatus 270/pole 12 assembly shown in FIG. 15.

FIGS. 15 and 16 show another preferred embodiment of a reinforcing apparatus 270 according to the present invention that is similar to the reinforcing apparatus 190 of FIG. 11 and comprises flanges 272, 274 meeting with an intermediate section 276 at junctions 278 and 280. However, the thickness of the flanges 272, 274 has been increased in comparison to the flanges 194, 196 of the reinforcing apparatus 190 (FIG. 11), as shown by plate portions 282 and 284. The added thickness can be provided by plates secured to the flanges 272, 274 such as by welding, bolting and the like, or the flanges can be preformed in that configuration. While the plates 282, 284 are shown secured to the inside of the flanges 272, 274, immediately proximate the intermediate section 276, the plates can also be secured to the outside of the flanges. Also, as shown in FIG. 16, the increased thickness sections 282, 284 need not extend the entire length of the reinforcing apparatus 270, but, in use, preferably extend along a portion of the flanges 272, 274 into the ground 92 and above ground level 14. This is the portion of the reinforcing apparatus 270 directly adjacent to the weathered portion of the pole 12 which usually occurs within the vicinity of ground level 14.

Also, FIGS. 15 and 16 illustrate that the various pole reinforcing apparatus of the present invention can be oriented on a utility pole 12 such that the pole is cradled between the spaced apart junctions 278, 280 contacting the pole 12 with the intermediate section 276 contacting the pole at an intermediate, contact point 286, aligned along fastener 288. This multi-point contact configuration can be further augmented by providing the flanges 272, 274 meeting with outwardly turned U-shaped junctions (not shown) that extend to respective second flanges having their terminal ends contacting the pole.

FIGS. 17 and 18 are views of a representative reinforcing apparatus 290 according to the present invention secured to a utility pole 12 and provided with a protective cover 292. Protective cover 292 is used to enclose any of the various present invention reinforcing apparatus. Similarly, a top cover 294 is secured to pole 12 and extends over the top of the reinforcing apparatus. Bands 296 surround the reinforcing apparatus 290, cover 292 and pole 12, thereby helping to retain the reinforcing apparatus in a secured engagement with the pole.

FIG. 19 shows an alternate embodiment of a protective cover 300 associated with a representative reinforcing apparatus 302 according to the present invention.

In this embodiment, the terminal ends 304, 306 of flanges 308, 310 are directed toward, and preferably in contact with the pole 12. Reinforcing apparatus 302 is secured to the pole 12 by fasteners 312 (only one shown), which are disposed through an intermediate section 314 and into the pole 12. In this construction, the intermediate section 314 does not contact the pole 12 at a location between the terminal ends 304, 306 of the respective flanges 308, 310.

Thus, the various embodiments of the reinforcing apparatus of the present invention illustrate that the pole is cradled in the intermediate section between the spaced apart flanges extending away from the pole (FIG. 15) or the pole is cradled by the terminal ends of the spaced apart flanges with (FIGS. 11 to 14) or without the intermediate section contacting the pole (FIG. 19) at a location between the flanges. In any event, the reinforcing apparatus according to the present invention serves to align the elastic axis and the shear center of the reinforcing apparatus closer to the longitudinal axis of the pole and the point of load transfer from the pole than is capable with the prior art reinforcing apparatus to thereby help support the pole and the point of load transfer from the pole nd prevent twisting of the reinforcing apparatus.

While the invention has been described in connection with specific embodiments thereof, it will be understood that this is by way of illustration and not of limitation and that the scope of the invention should be construed as broadly as the prior art will permit.

What is claimed is:

1. An apparatus, which comprises:

(a) at least one pair of spaced apart, outermost flanges;

(b) an intermediate section extending to and meeting with the spaced apart, outermost flanges, wherein the apparatus has a length between first and second ends of the intermediate section meeting the spaced apart flanges; and (c) a first plane tangent to respective junctions between the intermediate section and the spaced apart, outermost flanges, wherein an apex portion of the intermediate section between the junctions is spaced from the first plane and wherein the first plane does not intersect any part of the apparatus except tangent to the apparatus at the junctions where the intermediate section meets the spaced apart, outermost flanges, wherein the apparatus is symmetrical along a second plane bisecting the intermediate section and extending to the first and second ends.

2. The apparatus of claim 1 wherein a shear center of the reinforcing apparatus is located at a position selected from the group consisting of spaced from the first plane and outside the confines of the first plane and the intermediate section, within the confines of the first plane and the intermediate section, along the first plane, and coincident with the intermediate section.

3. The apparatus of claim 1 wherein the reinforcing apparatus is unsymmetrical along a third plane tangent to the apex portion.

4. The apparatus of clam 1 further including at least one fastener for securing the apparatus to a pole.

5. The apparatus of claim 4 wherein the fastener comprises at least one band having a length sufficient to surround at least a portion of the apparatus and at least a portion of the pole such that the apparatus is securable to the pole by the band.

6. The apparatus of claim 4 wherein the fastener comprises at least one bolt extendable through the intermediate section and into the pole such that the apparatus is securable to the pole by the bolt.

7. The apparatus of claim 4 wherein the apparatus is securable to the pole by the fastener with the intermediate section spaced from the pole.

8. The apparatus of claim 4 wherein the apparatus is securable to the pole by the fastener with at least a portion of the intermediate section contactable with the pole.

9. The apparatus of claim 1 wherein the apparatus is constructed from a material comprising 36,000 steel having a yield strength of at least about 36,000 psi.

10. The apparatus of claim 1 wherein the apparatus is constructed of a material selected from the group consisting of steel, aluminum and composites of fiber reinforced materials. extends away from the first plane tangent to the terminal ends of the spaced apart, outermost flanges.

11. The apparatus of claim 1 wherein the intermediate section has a generally V-shaped cross section providing the apex portion of the intermediate section and wherein an apex of the V extends away from the first plane and towards a fourth plane tangent to the terminal ends of the spaced apart, outermost flanges.

12. The apparatus of claim 1 wherein the intermediate section has a generally U-shaped cross section providing the apex portion of the intermediate section and wherein an apex of the U extends away from the first plane and towards a fourth plane tangent to the terminal ends of the spaced apart, outermost flanges.

13. The apparatus of claim 1 wherein the intermediate section has a generally channel-shaped cross section providing the apex portion of the intermediate section and where a trough of the channel extends away from the first plane and towards a fourth plane tangent to the terminal ends of the spaced apart, outermost flanges.

14. The apparatus of claim 1 wherein the intermediate section has a generally V-shaped cross section providing the apex portion of the intermediate section and wherein an apex of the V extends towards the first plane and away from a fourth plane tangent to the terminal ends of the spaced apart, outermost flanges.

15. The apparatus of claim 1 wherein the intermediate section has a generally U-shaped cross section providing the apex portion of the intermediate section and wherein an apex of the U extends towards the first plane and away from a fourth plane tangent to the terminal ends of the spaced apart, outermost flanges.

16. The apparatus of claim 1 wherein the intermediate section has a generally channel-shaped cross section providing the apex portion of the intermediate section and wherein a trough or the channel extends towards the first plane and away from a fourth plane tangent to the terminal ends of the spaced apart, outermost flanges.

17. The apparatus of claim 1 wherein the spaced apart, outermost flanges are parallel with respect to each other.

18. The apparatus of claim 1 wherein the spaced apart, outermost flanges are angled with respect to each other.

19. The apparatus of claim 1 wherein the spaced apart, outermost flanges comprise a first portion extending from the intermediate section and a second portion extending from the first portion and meeting the first portion at an angle.

20. The apparatus of claim 1 wherein the spaced apart, outermost flanges meet the intermediate section at respective U-shaped junctions.

21. The apparatus of claim 19 wherein at least one of the U-shaped junctions is inwardly turned.

22. The apparatus of claim 19 wherein at least one of the U-shaped junctions is outwardly turned.

23. An assembly comprising a reinforcing apparatus secured to a utility pole for supporting the pole against transverse wind force components, the assembly comprising:

(a) an intermediate section extending to and meeting with spaced apart, outermost flanges so as to form junctions at the intersections of the intermediate section and the spaced apart flanges, wherein a first plane is tangent to the respective junctions between the intermediate section and the flanges, and wherein the first plane does not intersect any part of the reinforcing apparatus except tangent to the apparatus at the junctions where the intermediate section meets the spaced apart, outermost flanges;

b) the intermediate section, the flanges and the junctions extending axially at least partway along the utility pole when the reinforcing apparatus is secured thereto; and (c) the intermediate section characterized by an apex portion that deflects either towards or away from the first plane, wherein the apex portion of the intermediate section is spaced from the first plane.

24. The apparatus of the claim 23 wherein one of the spaced apart, outermost flanges is shorter than the other of the flanges.

25. The apparatus of claim 23 wherein at least a portion of one of the spaced part, outermost flanges has a thickness greater than that of the intermediate section and the other flange.

26. The apparatus of claim 23 wherein the reinforcing apparatus is symmetrical along a second plane bisecting the intermediate section.

27. The assembly of claim 23 wherein the junctions are generally curved.

28. The assembly of claim 23 wherein the junctions are angular.

29. The assembly of claim 23 wherein the apparatus contacts the pole at terminal ends of the spaced apart flanges.

30. The assembly of claim 23 wherein the intermediate section contacts the pole at an intermediate location between the spaced apart, outermost flanges contacting the pole.

31. The assembly of claim 23 wherein the intermediate section is spaced from the pole.

32. An apparatus for reinforcing a pole, which comprises:

(a) at least one pair of spaced apart, outermost flanges;

(b) an intermediate section extending to and meeting with the spaced apart, outermost flanges, wherein the apparatus has a length between first and second ends of the intermediate section meeting the spaced apart flanges; and (c) a first plane tangent to respective junctions between the intermediate section and the spaced apart flanges, wherein an apex portion of the intermediate section between the junctions is spaced from the first plane and deflects either towards or away from the first plane, and wherein the first plane does not intersect any part of the reinforcing apparatus except tangent to the apparatus at the junctions where the intermediate section meets the spaced apart, outermost flanges and wherein the reinforcing apparatus is symmetrical along a second plane bisecting the intermediate section and extending to the first and second ends, and unsymmetrical along a third plane tangent to the apex portion, and wherein a shear center of the reinforcing apparatus is located at one of the locations consisting of:

i) spaced from the first plane tangent to the respective junctions between the intermediate section and the flanges and outside the confines of the first plane and the intermediate section;

ii) within the confines of the first plane and the intermediate section;

iii) along the first plane; and iv) coincident with the intermediate section.

33. A method of reinforcing a pole, comprising the steps of:

(a) providing a reinforcing apparatus comprising at least one pair of spaced apart, outermost flanges; an intermediate section extending to and meeting with the spaced apart, outermost flanges; and a first plane tangent to respective junctions between the intermediate section and the spaced apart, outermost flanges, wherein the first plane does not intersect any part of the reinforcing apparatus except tangent to the apparatus at the junctions where the intermediate section meets the spaced apart, outermost flanges and wherein an apex portion of the intermediate section between the junctions is spaced from the first plane and deflects either towards or away from the first plane; and (b) securing the reinforcing apparatus to the pole such that the reinforcing apparatus extends along a length thereof, partly below a ground level and partly above the ground level.

34. The method of claim 33 including providing a shear center of the reinforcing apparatus located at a position selected from the group consisting of spaced from the first plane and outside the confines of the first plane and the intermediate section, within the confines of the first plane and the intermediate section, along the first plane, and coincident with the intermediate section.

35. The method of claim 33 including providing the reinforcing apparatus being symmetrical along a second plane bisecting the intermediate section.

36. The method of claim 33 including providing the reinforcing apparatus being unsymmetrical along a third plane tangent to the apex portion.

37. A method of supporting a utility pole against transverse wind force components, comprising the steps of:

(a) providing a reinforcing apparatus comprising an intermediate section extending to and meeting with spaced apart, outermost flanges so as to form junctions at the intersections of the intermediate section and the spaced apart flanges, wherein a first plane is tangent to the respective junctions between the intermediate section and the flanges, and wherein the first plane does not intersect any part of the reinforcing apparatus except tangent to the apparatus at the functions where the intermediate section meets the spaced apart, outermost flanqes;

(b) securing the reinforcing apparatus to the pole with the intermediate section, the flanges and the junctions extending axially at least partway along the utility pole; and (c) providing the reinforcing apparatus secured to the utility pole having the intermediate section of the reinforcing apparatus characterized by an apex portion that is spaced from the first plane and deflects either towards or away from the first plane.

38. The method of claim 37 including providing the apparatus contacting the pole at terminal ends of the spaced apart flanges.

39. The method of claim 37 including providing the intermediate section contacting the pole at an intermediate location between the spaced apart, outermost flanges contacting the pole.

40. The method of claim 37 including providing the intermediate section spaced from the pole.

41. A method of reinforcing a pole, comprising the steps of:

(a) providing a reinforcing apparatus comprising at least one pair of spaced apart, outermost flanges; an intermediate section extending to and meeting with the spaced apart, outermost flanges; and a first plane tangent to respective junctions between the intermediate section and the spaced apart flanges, wherein an apex portion of the intermediate section between the junctions is spaced from the first plane and deflects either towards or away from the first plane, wherein the first plane does not intersect any part of the reinforcing apparatus except tangent to the apparatus at the junctions where the intermediate section meets the spaced apart, outermost flanges and wherein the reinforcing apparatus is symmetrical along a second plane bisecting the intermediate section and unsymmetrical along a third plane tangent to the apex portion, and wherein a shear center of the reinforcing apparatus is located at one of the locations consisting of:

i) spaced from the first plane tangent to the respective junctions between the intermediate section and the flanges and outside the confines of the first plane and the intermediate section;

ii) within the confines of the first plane and the intermediate section;

iii) along the first plane; and iv) coincident with the intermediate section; and (b) securing the reinforcing apparatus to the pole such that the reinforcing apparatus extends along a length thereof, partly below a ground level and partly above the ground level.

42. An apparatus, which comprises:

(a) at least one pair of spaced apart, outermost flanges;

(b) an intermediate section extending to and meeting with the spaced apart, outermost flanges; and (c) a first plane tangent to respective junctions between the intermediate section and the spaced apart, outermost flanges, wherein the intermediate section has a generally V-shaped cross section providing an apex portion of the intermediate section between the junctions spaced from the first plane with an apex of the V extending away from the first plane tangent to the terminal ends of the spaced apart, outermost flanges and wherein the first plane does not intersect any part of the apparatus except tangent to the apparatus at the junctions where the intermediate section meets the spaced apart, outermost flanges.

* * * * *

UNITED STATES PATENT AND TRADEMARK OFFICE

CERTIFICATE OF CORRECTION

PATENT NO. : 6,079,165

DATED : 6/27/00

INVENTOR(S) : Bingel, III et al.

It is certified that error appears in the above-identified patent and that said Letters Patent is hereby corrected as shown below:

Col. 12, lines 2-3 - delete "extends away from the first plane tangent to the terminal ends of the spaced apart, outermost flanges."

Col. 12, line 35 - "or" should be --of--.

Col. 14, line 35 - "functions" should be --junctions--.

Col. 14, line 37 - "flanqes" should be --flanges--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*